United States Patent [19]

Manno, Sr.

[11] 4,328,970

[45] May 11, 1982

[54] MAGNETIC BOARD GAME

[76] Inventor: Scott E. Manno, Sr., 10025 St. Clair Ave., Fairview Heights, Ill. 62208

[21] Appl. No.: 970,635

[22] Filed: Dec. 18, 1978

[51] Int. Cl.[3] ..... A63F 3/00

[52] U.S. Cl. ..... 273/239; 273/243; 273/287

[58] Field of Search ..... 273/236, 239, 241, 153 P

[56] References Cited

U.S. PATENT DOCUMENTS

| | | | |
|---|---|---|---|
| 303,946 | 8/1894 | Ohlert | 273/153 P |
| 983,730 | 2/1911 | Leach | 273/153 P |
| 1,419,871 | 6/1922 | McDonald | 273/153 P |
| 3,111,320 | 11/1963 | Acosta | 273/271 |
| 3,556,526 | 1/1971 | Currie | 273/239 |

*Primary Examiner*—Richard C. Pinkham
*Assistant Examiner*—Carl Moy
*Attorney, Agent, or Firm*—Paul M. Denk

[57] ABSTRACT

This game consists primarily of a plurality of stands having vertically extending pegs, for receiving plastic coated discs, which are magnetic. Each player selects the color desired, in pegs, stands and discs, and the object of the game is for one player to win all of the opponents' discs. The discs, when dropped upon another player's peg may be attracted to each other, or repelled from each other, depending upon their magnetic polarity.

4 Claims, 4 Drawing Figures

MAGNETIC BOARD GAME

This invention relates to recreational devices, and more particularly to a game.

It is, therefore, the principal object of this invention to provide a game, which will be unique and novel.

Another object of this invention is to provide a game, which will be played with stand mounted pegs, upon which, discs are dropped for scoring the game.

A further object of this invention is to provide a game, which may be played by persons numbering from two to eight.

A still further object of this invention is to provide a game, which will employ the use of magnetic discs, that will repell each other, or attract each other, when placed against one another in position on a player's peg.

Other objects of the invention are to provide a game, which is simple in design, inexpensive to manufacture, and easy to play.

These, and other objects, of the invention, will become readily evident upon a study of the specification, and the accompanying drawings, in which.

Figure 1:
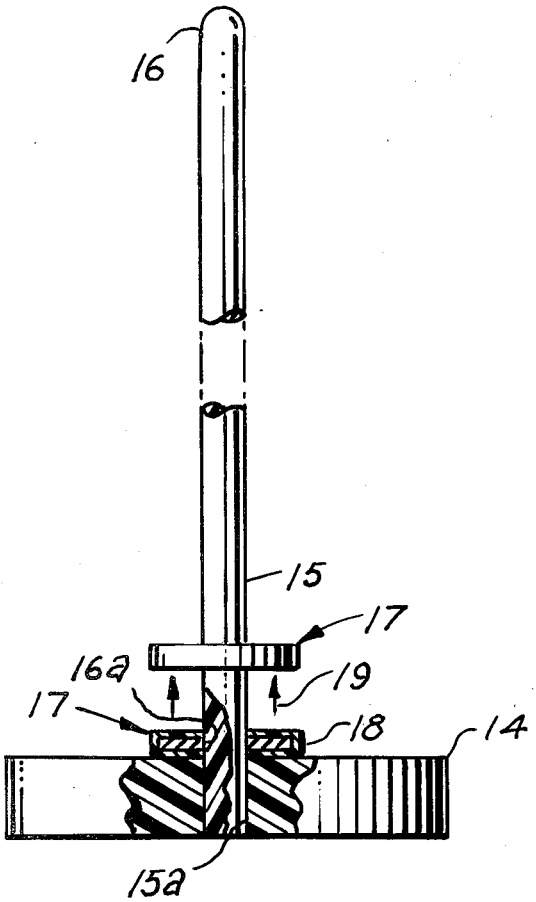
FIG. 1 is a vertical view of one of the stands of the present invention, which is shown in elevation, and partly in cross-section.
Figure 2:
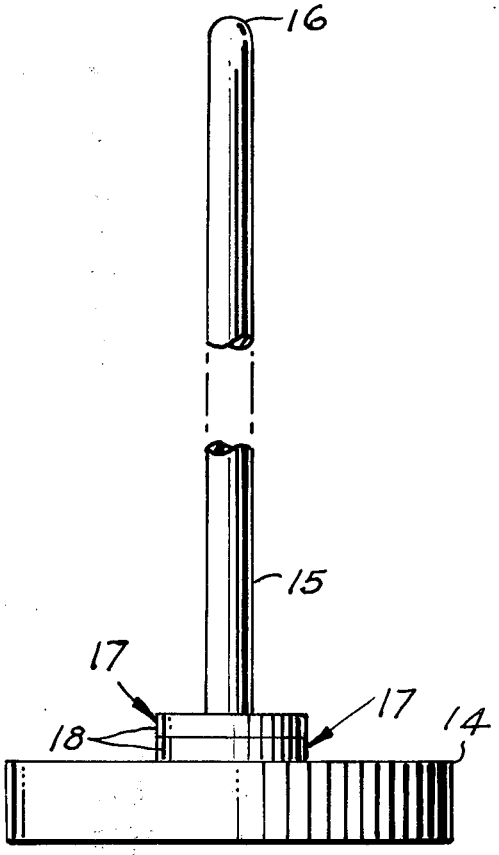
FIG. 2 is a view similar to FIG. 1, but shows the pair of discs shown magnetically attracted, or connected to each other.
Figure 3:
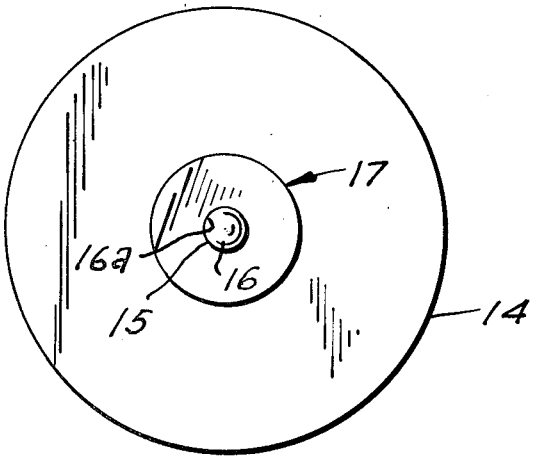
FIG. 3 is a top plan view of FIGS. 1 and 2.
Figure 4:
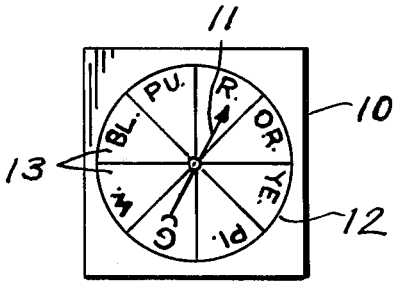
FIG. 4 is a top plan view of the spinner device of the present invention.

According to this invention, a game is shown to include spinner card 10, which is provided with a pivotal pointer 11, that is in the center of a circle 12. Circle 12 is divided into a plurality of segments 13, each of which indicates a color, so as to enable the players to select the color that will be used to start the game, as each player will have different colored playing pieces, which hereinafter will be described.

The game includes eight different colored plastic bases 14, in each of which is removably secured a peg 15, that must be of the same color. Pegs 15 are force fitted into opening 15*a* of their respective bases 14, and the rounded ends 16 of pegs 15 are freely received in the openings 16*a* of magnetic discs 17, which are coated with plastic 18. Each player receives four discs of the same color as their bases 14 and pegs 15.

Each player has his base 14 and peg 15 in front of him on a table, after which he will place one of his discs 17 on peg 15, whereupon it will descend down to the top of base 14. The players may hold the discs 17 in their hands, or place them on the table in front of them.

The rules of the game are as follows:

(a) In order to decide which player will move first, the youngest player will spin the pointer 11 on the card 10, and where the pointer 11 stops on an indicated color, the person having that color will move first.

(b) The person who has the first move, will drop one of his discs, (either side up), down the player's peg 15 on his left.

It shall be noted, that only one disc 17 should be on the base 14 at all times, unless the player uses it to drop.

(c) If the disc 17 dropped is magnetically repelled, as indicated by the arrows 19, that disc 17 belongs to the player it was dropped by, and it then becomes the next player's turn. If both discs 17 snap together by magnetic force, both discs 17 belong to the player who dropped his disc. He then proceeds to the next player, in a clockwise direction.

(d) He then drops a disc 17 on the next player's peg and if it repells, his turn is over, but he takes back the disc 17 which he dropped. It then becomes the next player's turn on his left. If the discs 17 snap together, he keeps playing, until it repells, but he still gets to take back his disc 17, if it repells, but his turn is over.

(e) A person may use any of the discs 17 he has, no matter what the color. He may also use the disc 17 on their base, to drop on another player, even if it is the only disc 17 he has.

(f) When a player is out of discs 17, he is out of the game.

(g) The player with all the discs 17, is the winner.

While various changes may be made in the detail construction, such details will be within the spirit and scope of the present invention, as is defined by the appended claims.

What I now claim is:

1. A game apparatus for a plurality of players comprising, a base means for each player, said bases each having indicia thereon distinct from the indicia on each other base, a single upstanding nonferrous peg fixed to each said base, each said peg having indicia thereon corresponding to the indicia on said base to which is it affixed, a plurality of sets of magnetic washers, dimensioned such that a plurality of washers may be placed over each said peg, said washers having their polarities at their side faces such that when two washers are placed over the same peg with like polarity faces adjacent each other the bottom piece is capable of supporting the upper piece in a vertically spaced apart relationship, each set of magnetic washers having indicia thereon corresponding to the said indicia on a different one of said bases, and a chance device capable of randomly indicating indicia corresponding to the said indicia on each said base.

2. The combination according to claim 1, wherein said plurality of bases are of non-ferrous material, and said elongated pegs are of non-ferrous material, and one end of said elongated pegs is frictionally received within an opening, vertical, and in the center of said plurality of bases and said magnetic discs have an opening therein, vertically and centrally through said discs, for receiving said plurality of elongated pegs.

3. The combination according to claim 2, wherein said magnetic discs have their polarities at their side faces, and when one is placed on one of said elongated pegs, and rests upon its respective base, and another is placed on top, with like polarities facing each other, they repell, and when unlike polarities face each other, they attract each other.

4. The combination according to claim 3, wherein said magnetic discs are coated with color for identification.

* * * * *